US009726445B2

(12) United States Patent
Gomez

(10) Patent No.: US 9,726,445 B2
(45) **Date of Patent: *Aug. 8, 2017**

(54) RIFLE CHARGING HANDLE

(71) Applicant: LWRC International LLC, Cambridge, MD (US)

(72) Inventor: Jesus S. Gomez, Trappe, MD (US)

(73) Assignee: LWRC International LLC, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/165,537

(22) Filed: May 26, 2016

(65) Prior Publication Data

US 2017/0038170 A1 Feb. 9, 2017

Related U.S. Application Data

(63) Continuation of application No. 14/579,704, filed on Dec. 22, 2014, now Pat. No. 9,377,258, which is a continuation of application No. 13/730,950, filed on Dec. 29, 2012, now Pat. No. 8,960,066.

(60) Provisional application No. 61/587,348, filed on Jan. 17, 2012.

(51) Int. Cl.

| | |
|---|---|
| ***F41A 3/72*** | (2006.01) |
| ***F41A 7/00*** | (2006.01) |
| ***F41A 35/06*** | (2006.01) |

(52) U.S. Cl.

CPC *F41A 3/72* (2013.01); *F41A 7/00* (2013.01); *F41A 35/06* (2013.01)

(58) Field of Classification Search

USPC ..... 89/1.4, 1.42; 42/43, 69.01, 69.02

See application file for complete search history.

(56) References Cited

U.S. PATENT DOCUMENTS

| | | | |
|---|---|---|---|
| 4,429,479 | A | 2/1984 | Johnson |
| 4,615,134 | A | 10/1986 | Beretta |
| 5,412,895 | A | 5/1995 | Krieger |
| 5,499,569 | A | 3/1996 | Schuetz |
| 5,519,954 | A | 5/1996 | Garrett |
| 6,508,158 | B2 | 1/2003 | Murello |
| 6,763,755 | B2 | 7/2004 | Johnson |
| 6,851,346 | B1 | 2/2005 | Herring |

(Continued)

OTHER PUBLICATIONS

In the U.S. Patent and Trademark Office, Office Action, in re: U.S. Appl. No. 12/923,841, dated Sep. 7, 2012, 11 pages.

(Continued)

*Primary Examiner* — J. Woodrow Eldred

(74) *Attorney, Agent, or Firm* — Porzio, Bromberg & Newman P.C.

(57) ABSTRACT

An ambidextrously operated charging handle for use with the M16 family of firearms is provided. The charging handle provides a latch mechanism consisting of two extended handles which are in operational communication with each other. Either handle may be independently retracted to disengage the latch mechanism of the charging handle from the host firearms receiver. The spring-biased mechanism of the charging handle is sheltered within the interior of the charging handle thereby protecting it from the elements. Further, an improved axial pin has been provided to secure the handles of the latch mechanism to the grasping portion of the charging handle.

12 Claims, 10 Drawing Sheets

EXPLODED

(56) References Cited

U.S. PATENT DOCUMENTS

| | | | | |
|---|---|---|---|---|
| 6,959,509 | B2 | 11/2005 | Vais | |
| 7,219,462 | B2 | 5/2007 | Finn | |
| 7,240,600 | B1 | 7/2007 | Bordson | |
| 7,363,740 | B2 | 4/2008 | Kincel | |
| 7,661,219 | B1 | 2/2010 | Knight, Jr. et al. | |
| 7,861,635 | B1 | 1/2011 | Hoel | |
| 7,900,546 | B2 | 3/2011 | Bordson | |
| 8,261,652 | B2 | 9/2012 | Findlay | |
| 8,336,436 | B2 | 12/2012 | Kincel | |
| 8,359,966 | B1 | 1/2013 | Brotherton | |
| 8,381,628 | B1 | 2/2013 | Wheatley | |
| 8,572,875 | B2 | 11/2013 | Sisgold | |
| 8,960,066 | B2 * | 2/2015 | Gomez | F41A 3/72 42/43 |
| 9,377,258 | B2 * | 6/2016 | Gomez | F41A 3/72 |
| 2006/0123683 | A1 | 6/2006 | Garrett et al. | |
| 2009/0031605 | A1 | 2/2009 | Robinson | |
| 2010/0275485 | A1 | 11/2010 | Findlay | |
| 2011/0005117 | A1 | 1/2011 | Bordson | |
| 2011/0174139 | A1 | 7/2011 | Olsen et al. | |
| 2011/0214558 | A1 | 9/2011 | Kincel | |
| 2011/0226120 | A1 | 9/2011 | Fitzpatrick et al. | |
| 2012/0167424 | A1 | 7/2012 | Gomez | |
| 2012/0291612 | A1 | 11/2012 | Kincel | |
| 2013/0174457 | A1 | 7/2013 | Gangl et al. | |
| 2014/0060293 | A1 | 3/2014 | Gomez | |
| 2015/0308760 | A1 | 10/2015 | Gomez | |
| 2015/0323271 | A1 | 11/2015 | McGinty | |

OTHER PUBLICATIONS

In the U.S. Patent and Trademark Office, Office Action, in re: U.S. Appl. No. 12/923,841, dated Feb. 27, 2013, 10 pages.

In the U.S. Patent and Trademark Office, Office Action, in re: U.S. Appl. No. 12/923,841, dated Sep. 17, 2014, 12 pages.

In the U.S. Patent and Trademark Office, Final Office Action, in re: U.S. Appl. No. 12/923,841, dated Apr. 14, 2015, 12 pages.

In the U.S. Patent and Trademark Office, Final Office Action, in re: U.S. Appl. No. 12/923,841, dated Oct. 10, 2013, 10 pages.

In the U.S. Patent and Trademark Office, Notice of Allowance, in re: U.S. Appl. No. 12/923,841, dated Jul. 14, 2016, 8 pages.

In the U.S. Patent and Trademark Office Notice of Allowance and Examiner initiated interview summary in re: U.S. Appl. No. 13/730,950, dated Oct. 7, 2014, 8 pages.

In the U.S. Patent and Trademark Office Notice of Allowance in re: U.S. Appl. No. 14/579,704, dated Mar. 3, 2016, 5 pages.

In the U.S. Patent and Trademark Office, Office Action, in re: U.S. Appl. No. 14/579,704, dated Jun. 19, 2015, 5 pages.

* cited by examiner

EXPLODED

CUT AWAY

EXPLODED

CUT AWAY

RIFLE CHARGING HANDLE

CROSS-REFERENCE TO RELATED APPLICATIONS

This application is a continuation of U.S. patent application Ser. No. 14/579,704, filed Dec. 22, 2015, which is a continuation of U.S. patent application Ser. No. 13/730,950, filed Dec. 29, 2012, now U.S. Pat. No. 8,960,066, which is a non-provisional application claiming priority from and the benefit of U.S. Provisional Application No. 61/587,348, filed Jan. 17, 2012. The contents of each is incorporated herein in their entirety.

BACKGROUND OF THE INVENTION

Field of the Invention

The present invention relates to firearms and, more particularly, to a ambidextrously operated charging handle for the manual manipulation of a firearms bolt carrier group, particularly the M16 family of firearms to include the AR15, AR10, M4 and all of their clones and derivatives.

Description of the Related Art

The charging handle is used to manually manipulate the bolt carrier group of a firearm. With the M16 family of firearms the charging handle is use to chamber an initial round of ammunition, clear malfunctions and as a means to retract the bolt carrier group for inspection of the firearms interior. In practice the charging handle is mounted within the upper receiver, engaging with a forward portion of the bolt carrier group, with the length of the handle running parallel with the bolt carrier group. In this orientation the handle portion of charging handle is manually operated to pull the bolt carrier group to the rear and load the first round of ammunition. Once the firearm is discharged the gas pressure produced by the discharged round of ammunition is sufficient to load subsequent rounds of ammunition.

This basic version of the charging handle has been in use since the early 1960's and is still the standard issue for all U.S. military M16/M4 style rifles and is found on the vast majority of clones used by civilians and law enforcement. The prior art charging handle for the M16 family of firearms has a shape approximating the capital letter "T", with the transverse member of the "T" acting now as the grasping handle. The grasping handle is rounded and relatively small making it difficult to gain and maintain a firm grip of, especially when gloves are employed or when the user is trying to rapidly operate the charging handle under stress. The grasping handle is provided with a latch mechanism having a spring biased hook at one end that engages on a portion of the upper receiver to hold the charging handle in place when it is not in use. The latch mechanism is located on the left side of the grasping handle and is designed to be compressed by the user against the forward face of the grasping handle, thereby compressing the biasing spring, disengaging the hook portion from the upper receiver and allowing the charging handle to be rearwardly retracted. Specifically due to the location and size of the latch mechanism on the grasping handle, its operation is difficult for left handed shooters and for right handed shooters using their left hand.

The prior art charging handle relies on a spring force to bias the latch element into operational engagement with the upper receiver and thereby retain the charging handle in place. This spring is visible when the charging handle is viewed from the rear thus exposing the spring to the elements. This exposure can result in rusting and/or contamination of the spring by debris from the environment.

Modified latch mechanisms and extended latch elements have been made in an attempt to address some of the above deficiencies found in the prior art. For example, the modified latch by PRI (Big Latch 05-0041, Precision Reflex, Inc, New Breman, Ohio) has an enlarged grasping surface that extends laterally past the grasping handle and includes a textured gripping surface. However, this extended latch design and those like it still have several deficiencies. This design, and those like it, fail to provide a latch element on the right side of the charging handle which is operable by a left handed shooter, or a right handed short using their left hand, to manually operate the bolt carrier group of the host firearm.

The prior art roll pin used to secure the latch mechanism to the grasping handle of the charging handle is another point of deficiency. The roll pin used is designed to provide a fulcrum for the latch mechanism. Many of the extended latches found in the market rely on the prior art roll pin to provide an axis of rotation and to resist the rearward movement of the latch while it is being operated. As a result, the extended latch element will shear through the roll pin during hard use thereby separating the latch mechanism from the charging handle. It would be highly advantageous, therefore, to remedy the foregoing and other deficiencies inherent in the prior art.

SUMMARY OF THE INVENTION

In view of the foregoing, one object of the present invention is to overcome the shortcomings in the design of charging handles for M16 type firearms as described above Another object of the present invention is to provide charging handle which can be ambidextrously operated.

Yet another object of the present invention is to provide a charging handle in accordance with the preceding objects in which an operable member of the latch mechanism is located on each side of the charging handle.

A further object of the present invention is to provide a charging handle in accordance with the preceding objects in which either operable member of the latch mechanism may be independently operated to disengage the charging handle from the firearms receiver.

A still further object of the present invention is to provide a charging handle in accordance with the proceeding objects in which the spring operating mechanism which biases the latch mechanism is protected from the elements.

Yet another object of the present invention is to provide a charging handle in accordance with the preceding objects in which both portions of the charging handles latch mechanism are secured in place through the use of a robust axial pin.

In accordance with these and other objects, the present invention is directed to a charging handle for use with an M16 type firearm. This charging handle may be retrofitted to an existing M16 type firearm without the need for any modification of the receiver of the firearm or any other part thereof.

The charging handle has a generally "T" shape with the forward end being configured to engage with a portion of a bolt carrier and the rear end acting as a grasping surface. There is provided a latch mechanism consisting of two handles that are in communication with each other through an intermediate element. One of the handles has a latch which engaged with a portion of a firearms receiver, but either handle may be retracted to disengage the latch. Each handle is independently secured to the charging handle thru the use of a robust axial pin.

In addition, the charging handle provides an internal housing for the spring and plunger which operationally connects the two handles of the latch mechanism. Each handle has a protrusion which is received within a recess located on the plunger. When either handle is retracted the plunger is depressed thereby retracting the other handle of the latch mechanism while at the same time disengaging the latch from the host firearms receiver.

These together with other improvements and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

In describing a preferred embodiment of the invention illustrated in drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is directed towards a charging handle for use with the M16 family of firearms which includes the AR15, AR10, M16 and M4 rifles of all varieties and other derivatives to include those which use a gas piston in place of a gas tube.

Figure 1:
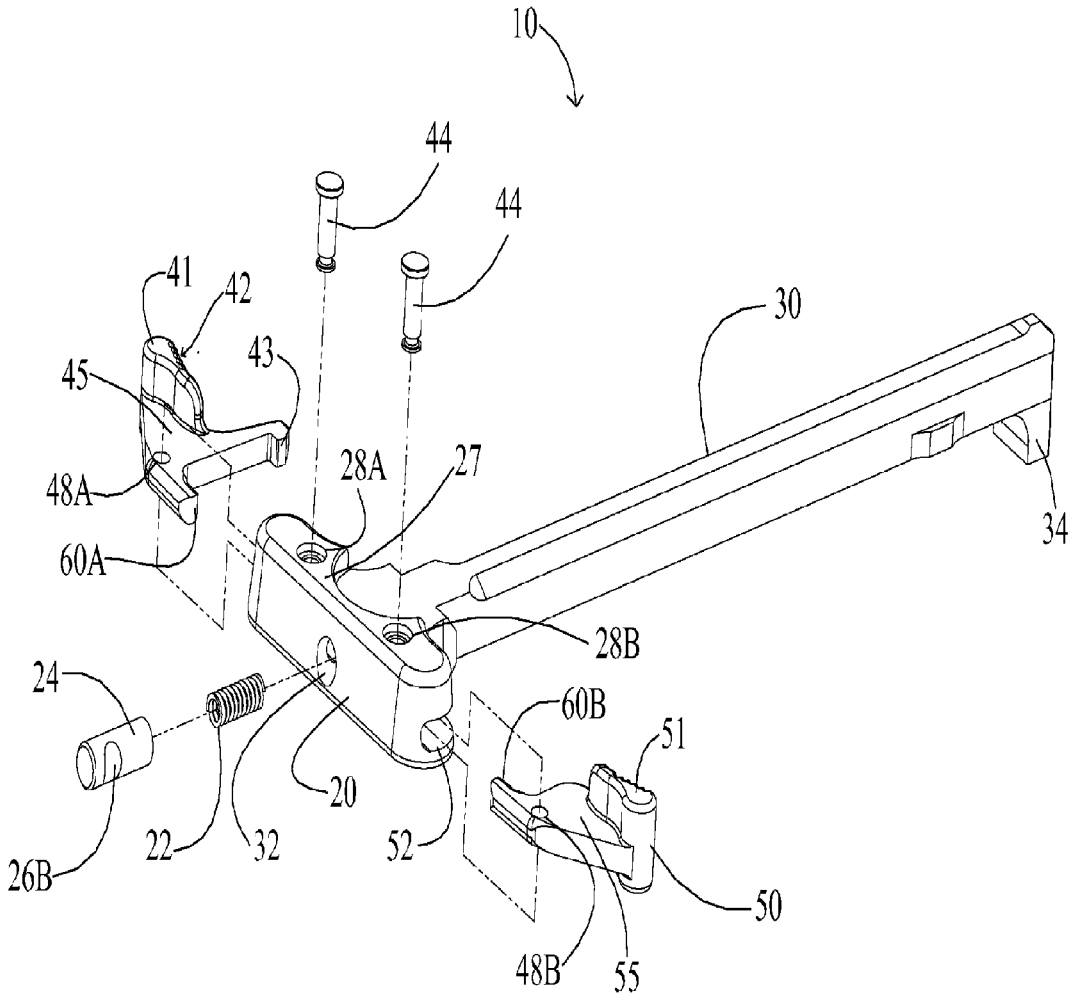
FIG. 1 is a perspective exploded view of the components of the present invention including a charging handle having a grasping handle, a primary handle with an integral latch, a secondary handle, two axial pins, a spring and a plunger.
Figure 3:
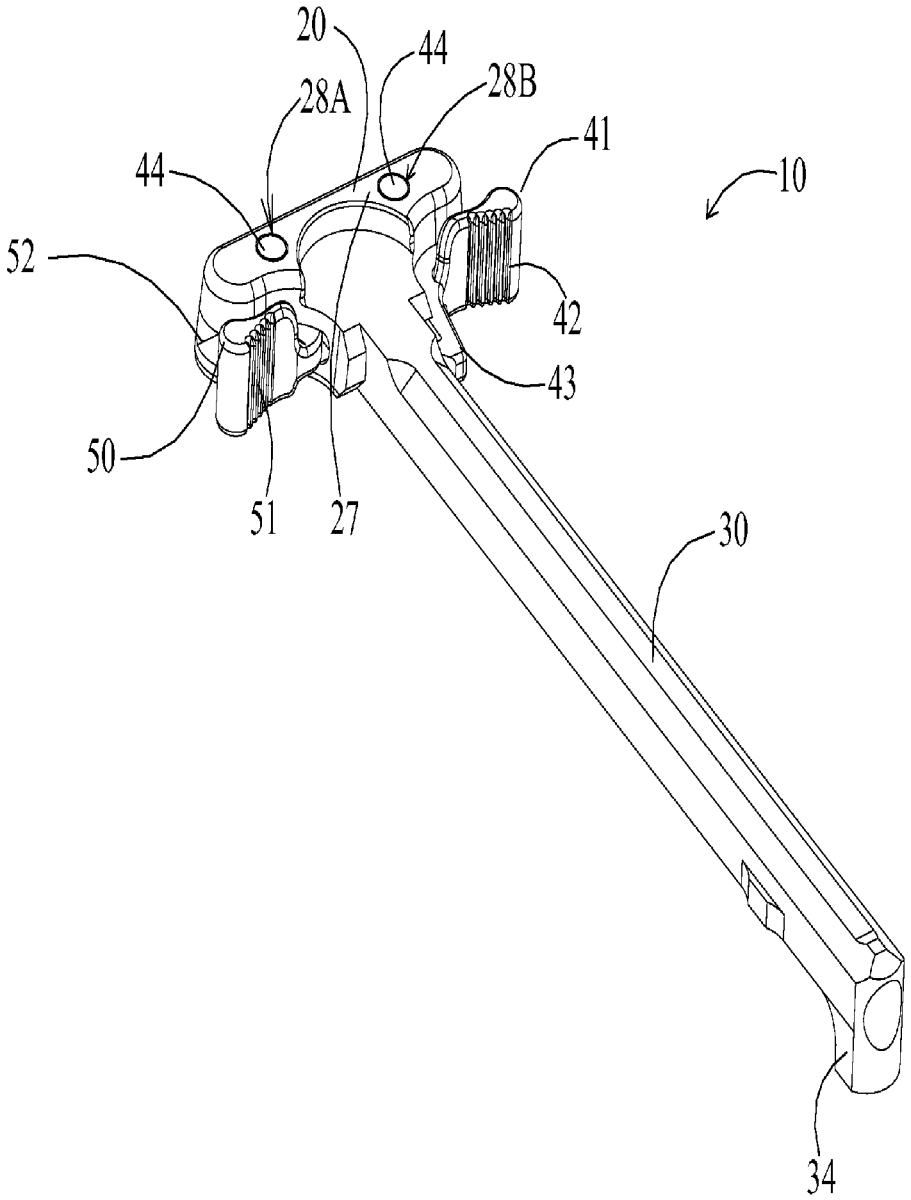
FIG. 3 is a perspective view of the charging handle shown in FIG. 1 as assembled.
Figures 4A, 4B, 4C:
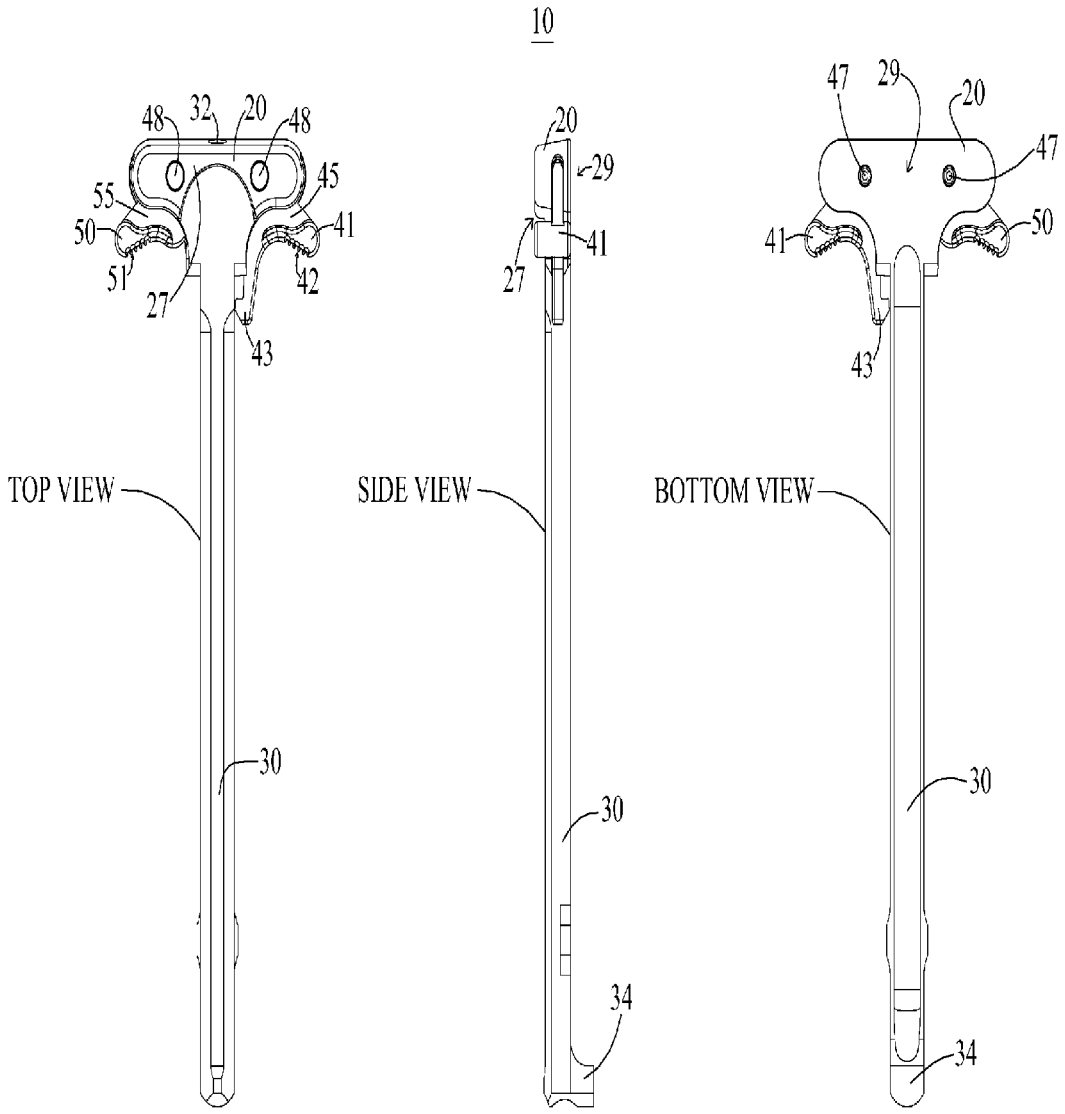
FIGS. 4A, 4B and 4C set forth top, side and bottom views of the charging handle, respectively.
Figure 5:
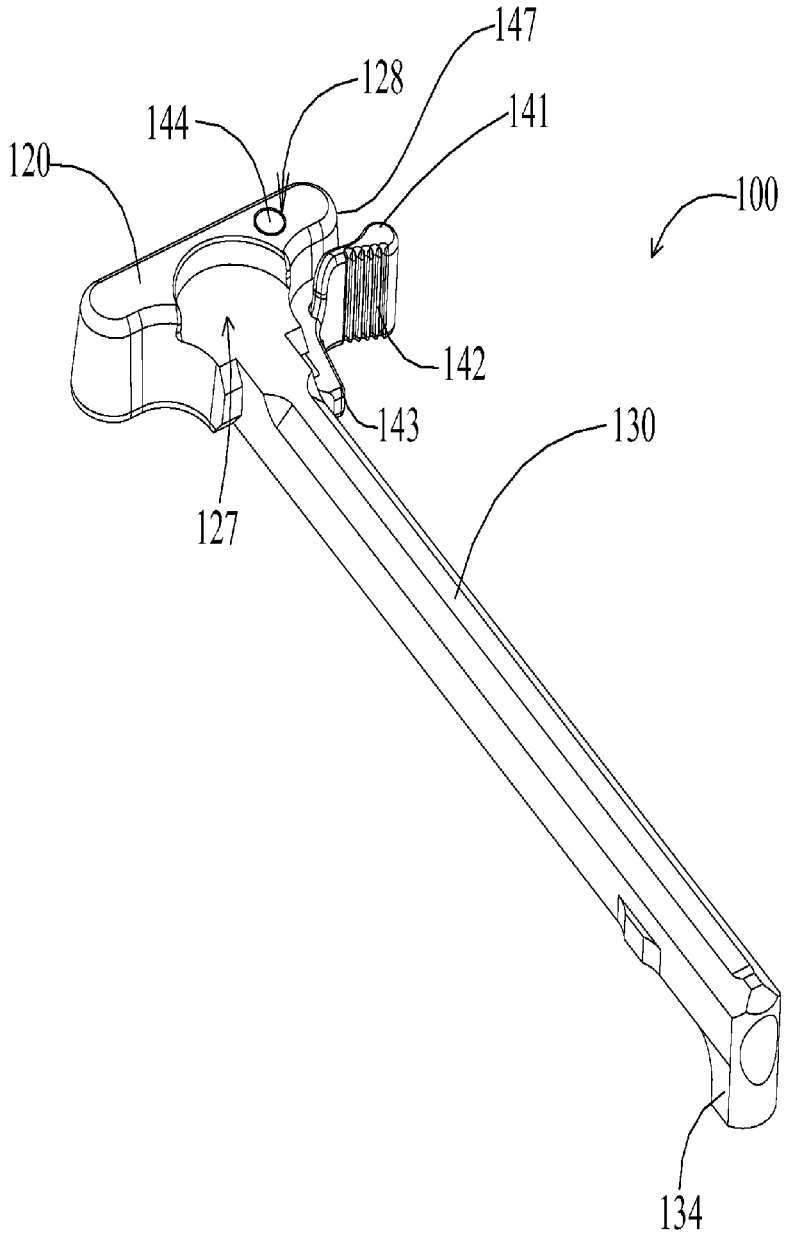
FIG. 5 is a front perspective view of an alternate embodiment charging handle having a grasping handle, a latch with extended handle and a pin.
Figure 6:
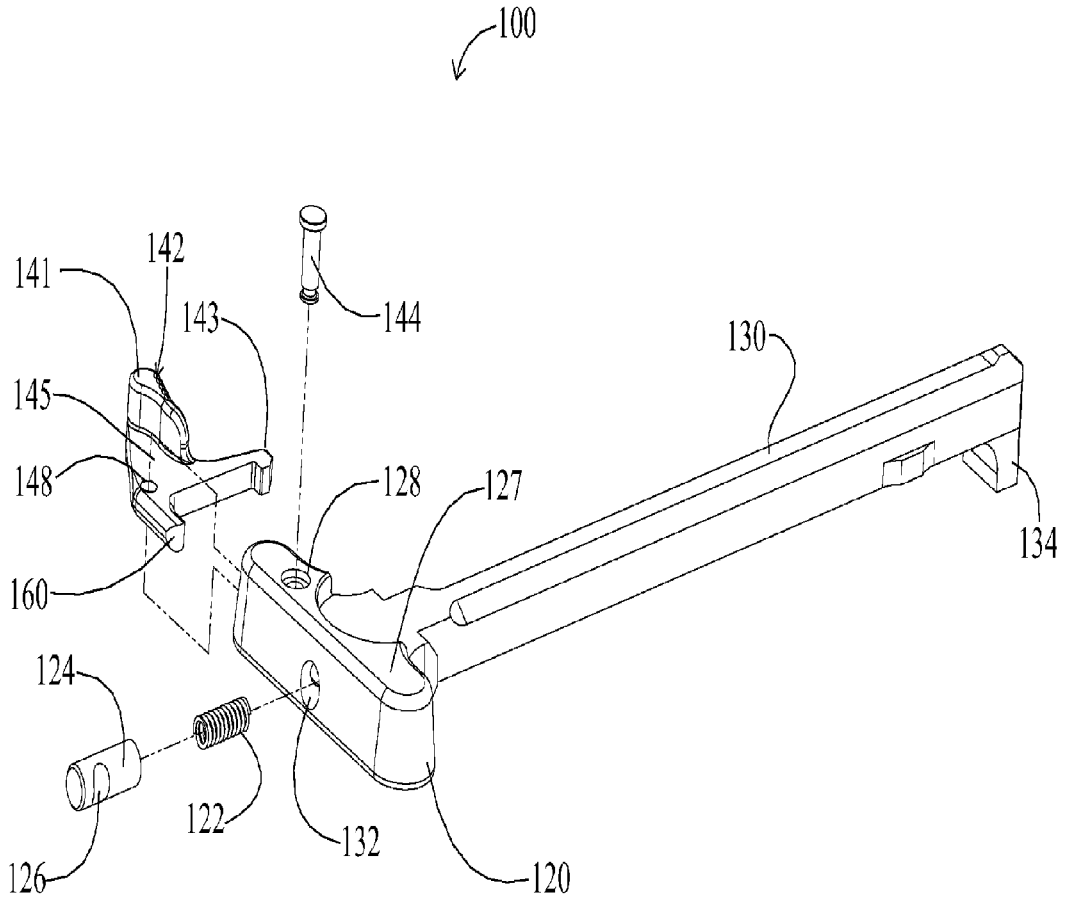
FIG. 6 is a perspective exploded view of the components of the alternate embodiment charging handle assembly shown in FIG. 5.

As used herein, "front", "forward", and "distal" correspond to the end of the charging handle 10 where the bolt carrier engagement portion 34 is located (i.e., to the right as shown in FIGS. 1 and 3); and "rear", "rearward", "back" or "proximal" correspond to the end of the charging handle 10 opposite the end where the bolt carrier engagement 34 portion is located (i.e., to the left as shown in FIGS. 1 and 3).

Figure 11:
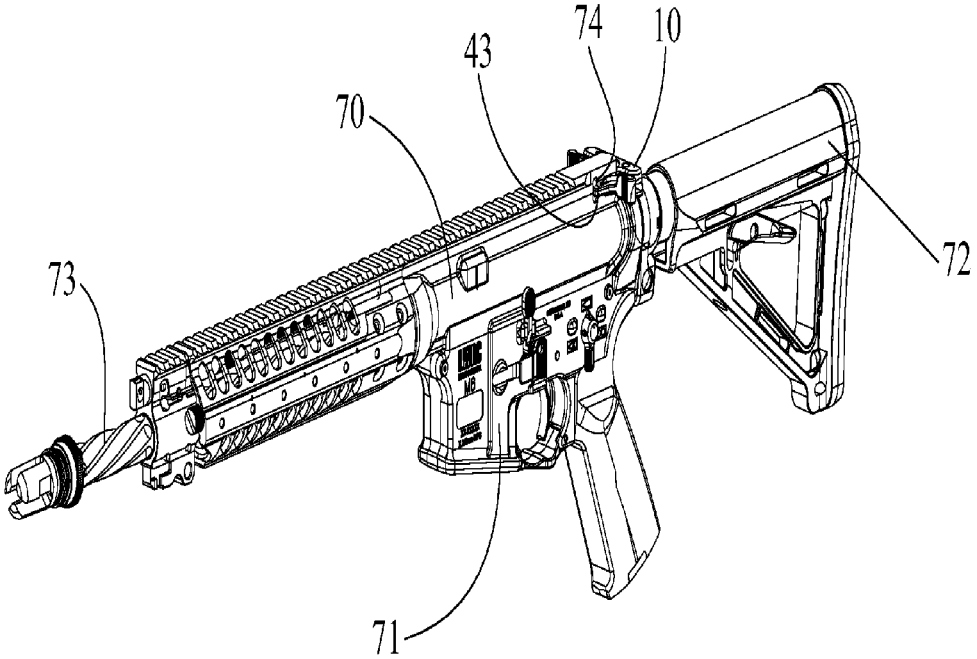
FIG. 11 is a side perspective view of the left side of an M16 type rifle which is suitable for use with the charging handle in accordance with the present invention.

As shown in FIG. 1, the present invention is directed to a charging handle assembly, generally designated by reference numeral 10, consisting of a shaft 30 which is integrally connected to a transverse member which acts as a grasping handle 20. The forward portion of the charging handle has a lip 34 which is configured to engage on a portion of a bolt carrier, well known in the prior art as it relates to the M16 family of firearms. It will be understood that the charging handle assembly 10 is intended to be employed with any M16 type firearm 80; however with minor modifications, some of its features could be more widely used for other firearms as well. It will also be understood that the charging handle is housed within an upper receiver 70 of an M16 type rifle 80 as shown in FIG. 11.

As shown in the exploded view of the charging handle assembly provided in FIG. 1, and the isolated views of the charging handle shown in FIGS. 2-3, 4A, 4B and 4C, the grasping handle 20 has an top 27 and bottom surface 29 with two recesses 46 and 52. The two recesses 46 and 52 of the grasping handle 20 in conjunction with the opening 32 are configured to house the latch mechanism 40 and are located between the top surfaces 27 and bottom surface 29 of the grasping handle 20. The two recesses 46 and 52 are in communication with each other through an interior aperture 56. The aperture 56 is defined by two side walls which are broken up along there length due to the presence of the opening 32. The interior side wall 35 is shorter in length than side wall 36 which forms an interior portion of the charging handle assemblies back side.

The latch mechanism 40 consists of a primary handle 41, a secondary handle 50, a spring 22 and plunger 24. The primary handle consists of a body 45 portion extending between a hook 43 formed on it's distil end, an integrally formed textured grasping surface 42 and protrusion 60A located on its proximal end. The secondary handle 50 has a body 55 portion extending between a protrusion 60B located adjacent is proximal end and a textured grasping surface 51 on it's distil end. The recess 46 located on the left side of the grasping handle 20 is configured to house the primary handle 41 while the recess 52 on the right side is configured to house the secondary handle 50. The hook 43 of the primary handle 41 is configured to engage with a recess found on all prior art upper receiver groups used with M16 type firearms.

Figure 2:
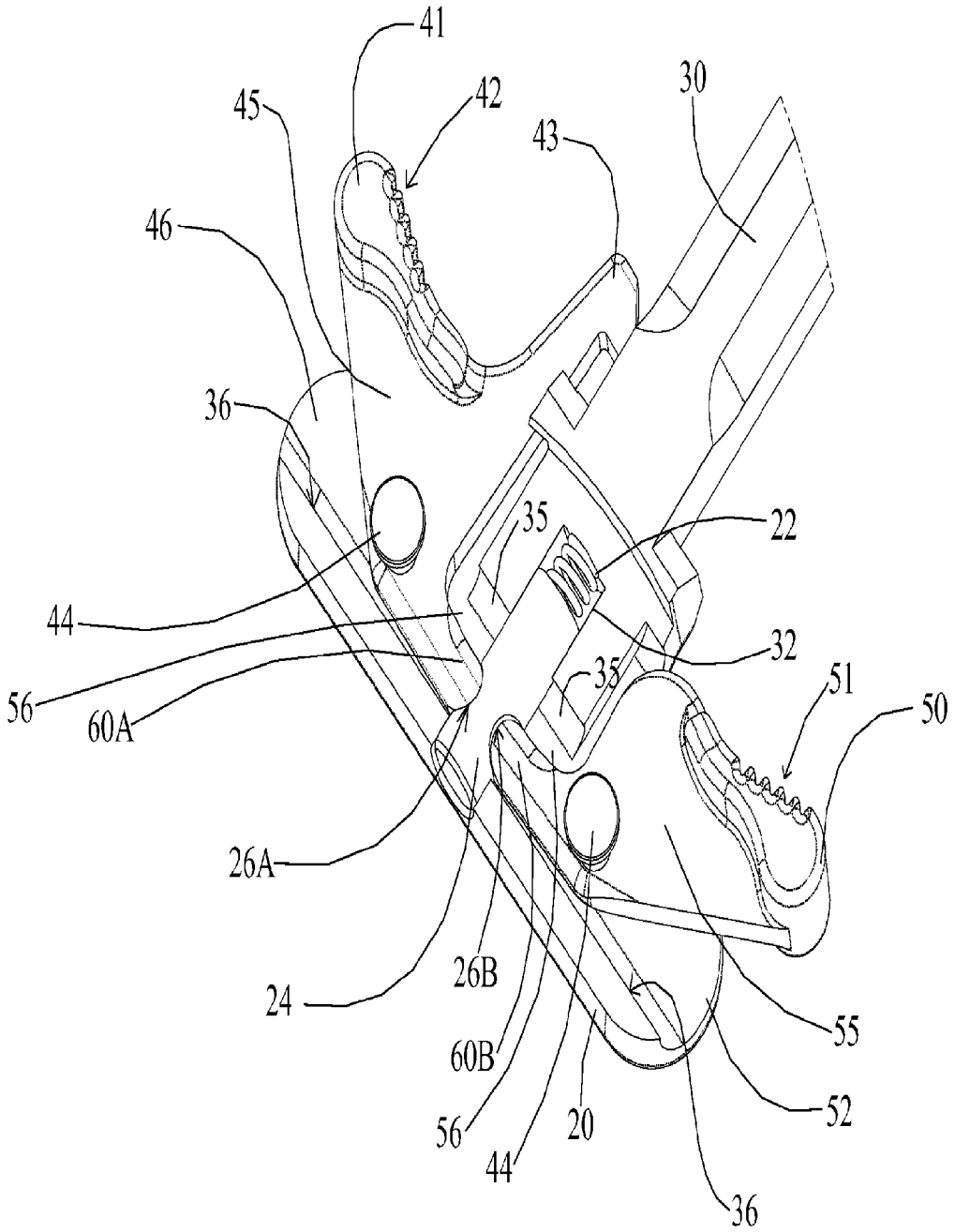
FIG. 2 is a partial top cutaway view of the grasping handle of the charging handle shown in FIG. 1.

Located on the back side of the grasping handle 20 is an opening 32 for the spring 22 and plunger 24 that includes a longitudinal bore which extends from the back end of the grasping handle 20 forward for a distance sufficient to accommodate the spring 22 and plunger 24 when the charging handle 10 is fully assembled (see FIG. 2). The plunger 24 has two identical recesses 26A and 26B located opposite each other that are configured to receive the protrusions 60A and 60B of the handles 41 & 50, respectively.

The recesses 26A and 26B of the plunger 24 are concave openings, with a semicircular shape if viewed from the side (see FIG. 2). The interior of each recess 26A and 26B has a radius which is smooth. The end of each protrusion 60A and 60B is convex and configured to be received by, and rotate within, either of the recesses 26A and 26B provided on the plunger 24. By housing the spring 22 and plunger 24 within the interior of the grasping handle 20, the plunger 24 and particularly the spring 22 are protected from the elements. This configuration minimizes or eliminates water, dust and other debris which could compromise proper function from coming into contact with the spring 22.

The grasping handle 20 of the charging handle assembly 10 is also provided two openings 28A and 28B which extend through its top surface 27 and bottom surface 29, each of which is of sufficient diameter and depth to receive an axial pin 44. The axial pin 44 has a head 48 portion, a tail portion 47 and is constructed from a solid piece of stainless steel, but alternatively could be constructed from any ferrous or aluminum alloy. Both the primary handle 41 and the secondary handle 50 have an opening 48A and 48B, respectively, which is designed to receive a portion of an axial pin 44 (see FIG. 1). The openings 48A and 48B are adjacent the proximal end of the primary handle 41 and the secondary handle 50. This positioning of the openings 48A and 48B is a significant departure from the prior art charging handles where the openings are adjacent the distil end of the charging handle. By positioning the openings 48A and 48B as they are, a more robust fulcrum in the form of the axial pin 44 may be used.

The axial pin 44 is essentially a rivet, having a head portion 48, trail portion 47 with a body portion 49 extending therebetween. The head portion 48 is larger in diameter than the body portion 49 which in turn is larger in diameter than the tail portion 47. To function as a fastener, the tail portion 47 of the axial pin 44 is deformed by an arbor press which simultaneously compresses and expands it.

The shaft 30 and grasping handle 20 portions of the charging handle assembly 10 are manufactured from 7075 aluminum, alternatively 6065 aluminum or other alloys with similar structural characteristics could be used. The shaft 30 and grasping handle 20 are machined from a single piece of aluminum that is type III hard coat anodized after machining.

The charging handle is assembled by inserting the spring 22 and plunger 24 into the provided opening 32 in the grasping handle 20. The primary handle 41 is then inserted into the recess 46 provided on the left side of the grasping handle 20 such that its protrusion 60A member is received by the recess 26A of the plunger 24 while the opening 48A on its body portion 45 is aligned with the opening 28A of the grasping handle 20. An axial pin is then pressed through the openings 28A and 48A of the grasping handle 20 and primary handle 41, respectively, securing the primary handle 41 in place. The axial pin 44 is secured in place by having its tail portion 47 deformed by an arbor press. The secondary handle 50 is inserted into the recess 52 found on the right side of the grasping handle 20 such that its protrusion 60B is received within the recess 26B of the plunger 24 while the opening 48B on its body portion 55 is aligned with the opening 28B of the grasping handle. Similarly, an axial pin 44 is pressed through the openings 28B and 48B of the grasping handle 20 and the secondary handle 50, respectively. The axial pin 44 is retained in place in the same manner as described above. The axial pins 44 both retain the handles 41 and 50 in place within their respective recesses 46 and 52 and provide a surface about which the handles 41 and 50 may rotate. The opening 32 which houses the plunger 24 runs perpendicular to an interior aperture 56 which connects the two recesses 46 and 52. The aperture 56 is of sufficient width to allow for the rotational movement of the protrusions 60A and 60B.

In the preferred embodiment, the primary handle 41 and secondary handle 50 each extend laterally past the exterior of the grasping handle 20 portion of the changing handle assembly 10. In some embodiments the width of the handles 41 and 50 grasping surface may be increased or decreased based on the end users needs without departing from the scope of the invention disclosed herein. Further, in the preferred embodiment of the charging handle assembly 10 the primary handle 41 and secondary handle 50 extend laterally past the exterior of the grasping handle 20 an equal distance as measured from the center line of the grasping handle 20. Both the primary and secondary handles 41 and 50 extend past the left and right sides of the grasping handle 20, respectively, by approximately 0.189".

To use the charging handle assembly 10 when assembled on a rifle 80 as shown in FIG. 11, the user may retract the primary handle 41 or the secondary handle 50 individually or simultaneously to disengage the hook 43 from the upper receiver 70. The decision to use one handle over the other or both simultaneously is dependent on a variety of factors. Some factors which affect how the charging handle is used are what type of optical gun sight the host rifle is equipped with, which hand is the users dominant and the current firing position of the user at the moment when the charging handle assembly 10 is used.

The charging handle assembly 10 functions as follow. Each handle 41 and 50 has an opening 48A and 48B, respectively, which receives and rotates about a portion of the axial pin 44 used to secure it to the grasping handle 20. While secured to the grasping handle the protrusion 60A of the primary handle 41 and the protrusion 60B of the secondary handle are secured within their respective recesses 26A and 26B on the plunger 24. The plunger 24 places each handle 41 and 50 in operational contact with the other.

When neither handle 41 and 50 are in use the spring 22 biases the plunger 24 towards the rearward end of the charging handle assembly 10, or first position. Retracting either handle 41 and 50 causes the force applied to the grasping surfaces 42 and 51 to be transferred to the plunger 24, thereby compressing the spring 22 and plunger 24 towards the forward end of the charging handle assembly 10. This in turn disengages the hook 43 of the primary handle 41 from the upper receiver 70 and also, through the operation of the plunger 24 and spring 22 results in both handles 41 and 50 being retracted even if only one of them is having a force applied to it by the user. This is also referred to as the second position for the latch mechanism 40.

The textured applied to the grasping surfaces 42 and 51 is intended to aid the user in acquiring and maintaining a grip on the handles 41 and 50 during use of the charging handle assembly 10.

Each axial pin 44 is constructed from a solid piece of metal and is larger in diameter that the prior art roll pin 90. The use of a solid pin of increased diameter, as compared to the prior art roll pin 90, results in a more robust axial pin 44 that is resistant to shearing. Shearing occurs when a force is applied to the latch during operation of the charging handle resulting in the latch shearing through the pin retaining it in place, particularly the prior art roll pin 90. Latches which extend laterally past the grasping handle are particularly prone to this failure, thus the need to provide a more robust means of securing a latch element(s) to the grasping handle exist.

An alternate embodiment of the charging handle assembly, generally designated by reference numeral 100, is illustrated in FIGS. 5-7, 8A, 8B & 8C. The charging handle assembly 100 is substantially the same as the preferred embodiment charging handle assembly 10 illustrated in FIG. 3, any differences are noted herein.

In general, the charging handle assembly 100 consists of a shaft 130 which is integrally connected to a transverse member which acts as a grasping handle 120 and a primary handle 141 with an integral hook 143. A bolt carrier engagement portion 134 is located on the forward end of the shaft 130. The primary handle 141 consists of a body portion 145 with the hook 143 being located at it's distil end connected to a gasping surface 142 and a protrusion 160 located at its proximal end. The grasping surface 142 of the primary handle 141 is textured. The primary handle 141 is housed within a recess 146 formed between the top surface 127 and bottom surface 129 of the grasping handles 120 left side. A longitudinal opening 132 located on the backside of the grasping handle is configured to receiver a spring 122 and plunger 124. The plunger 124 has two identical recesses 126A and 126B. The primary handle 141 is attached to the grasping handle 120 and retained in place though the use of an axial pin 144 in substantially the same manner as disclosed in connection with the preferred embodiment charging handle assemble 10 above.

Figure 7:
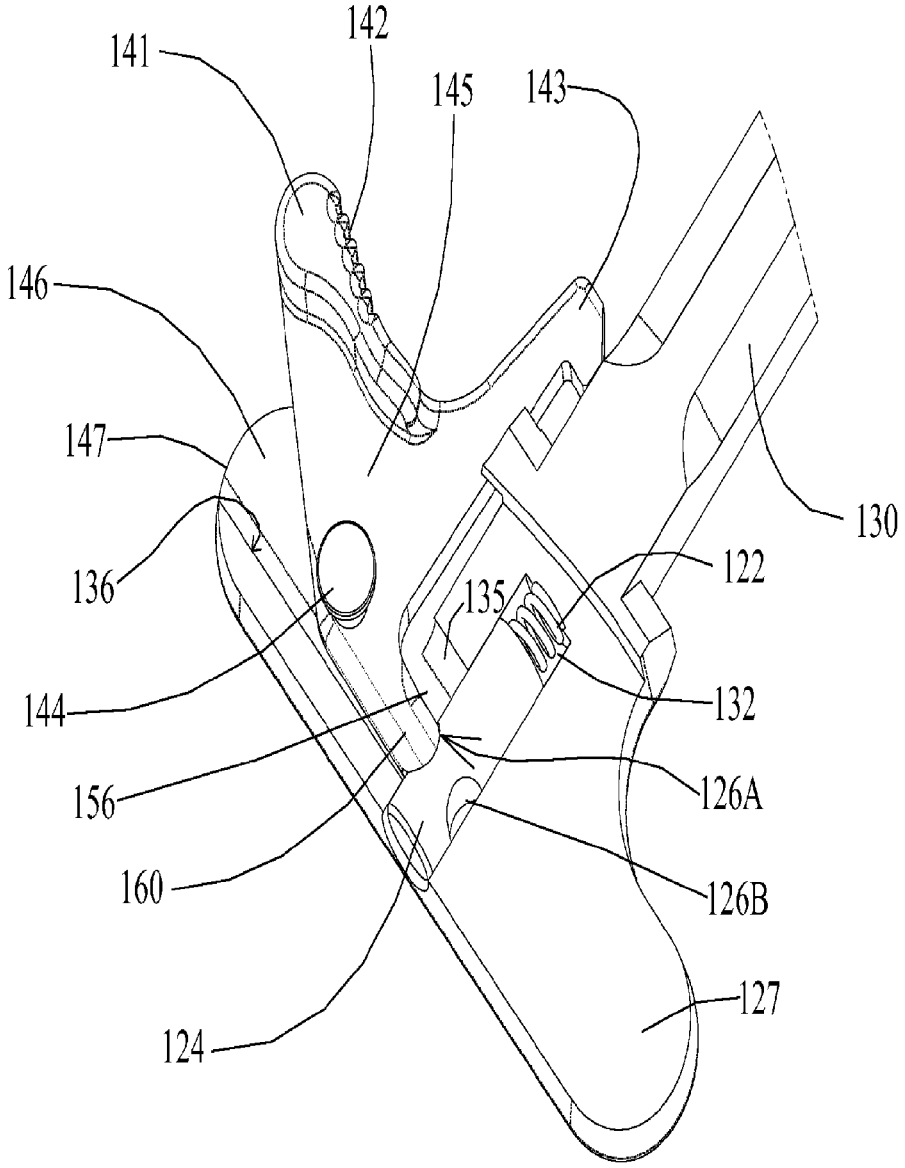
FIG. 7 is a partial cutaway view of the alternate embodiment charging handle assembly shown in FIG. 5.
Figures 8A, 8B, 8C:
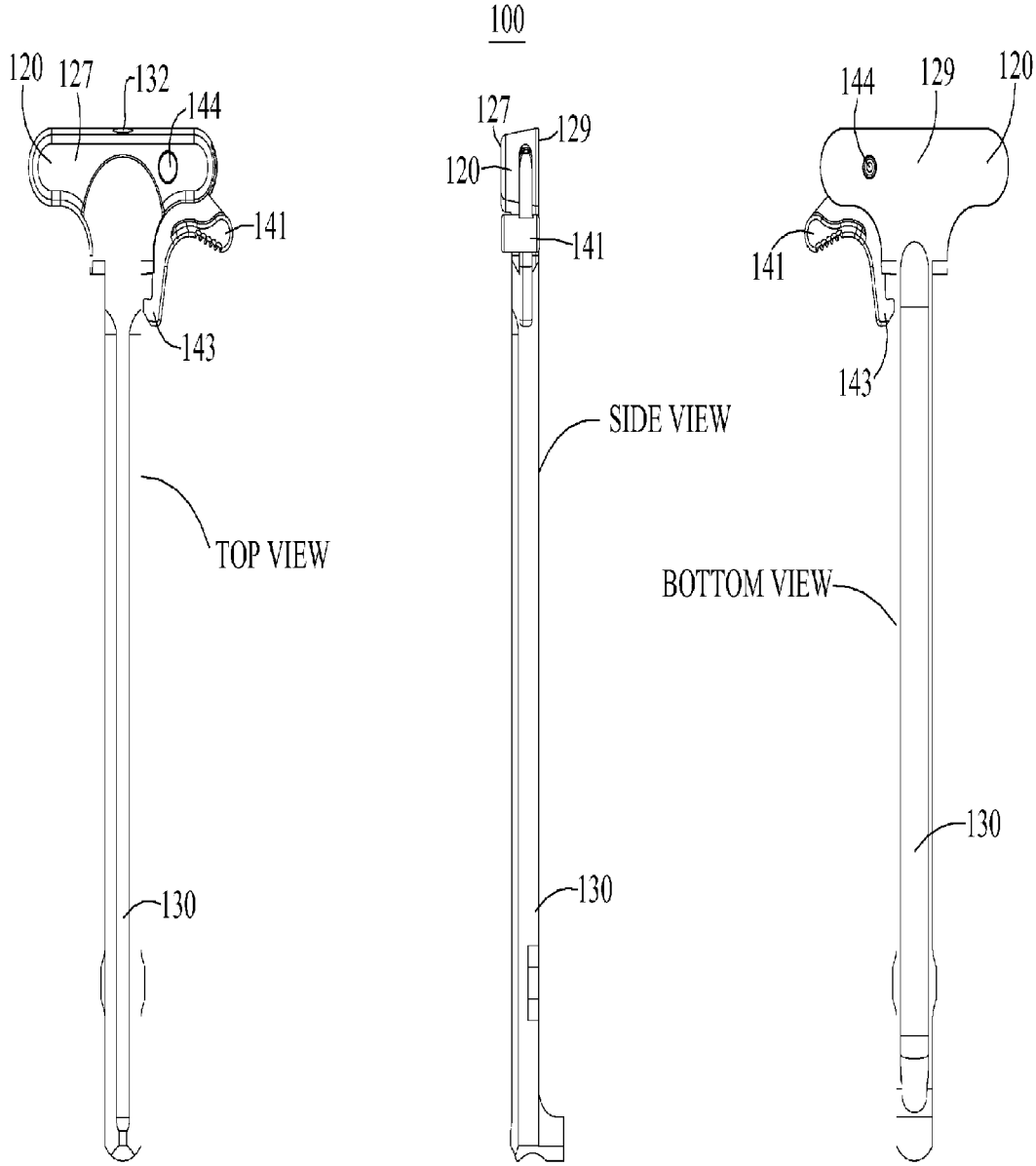
FIGS. 8A, 8B and 8C set forth top, side and bottom views, respectively, of the alternate embodiment charging handle assembly shown in FIG. 5.

As shown in the partial cutaway view in FIG. 7 located between the recess 146 for the primary handle 141 and the opening 132 for the spring 122 and plunger 124 is an aperture 156. The aperture 56 is defined by an interior side wall 135 which is shorter in length than a second side wall 136 which forms an interior portion of the charging handle assemblies 100 backside. This aperture 156 allows the protrusion 160 of the primary handle 141 to be received within one of the recesses 126A or 126B of the plunger 124.

The primary handle 141 of the charging handle assembly 100 laterally extends past the left side exterior 147 of the grasping handle 120 by approximately 0.189".

The alternate embodiment charging handle assembly 100 may be constructed from the same materials as the preferred embodiment charging handle assembly 10.

The texture applied to the grasping surfaces 42, 51 and 142 of the handles 41, 50 and 141 respectively is composed of a series of latitudinal furrows which form a series of peaks and valleys along the forward face of the handles 41, 50 and 141. The texture applied to these surfaces could be modified without departing from the inventive concepts disclosed herein.

The plunger 24 and spring 22 being housed within a longitudinally extending opening 32 within the grasping handle offers several benefits. First, when assembled the plunger protects the spring from water, dirt and other debris which may migrate into the inner workings of the charging handle and compromise the charging handles proper function. Second, the plunger places the two handles 41 and 50 into communication with each others, providing the user with operational flexibility and ambidextrous operation capabilities. Third, the plunger provides a robust way by which the handles 41 and 50 may be held in operational communication that is not likely to succumb to hard use. Fourth, the axial pin 44 provides a significantly more robust way to secure a rotatable handle to the grasping surface 20. Many of these same advantages are also offered by the alternate embodiment charging handle assembly 100.

Figure 9A:
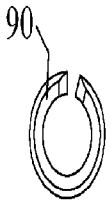
PRIOR ART FIG. 9A
FIGS. 9A and 9B show top and perspective views, respectively, of a prior art roll pin.
Figure 10A:
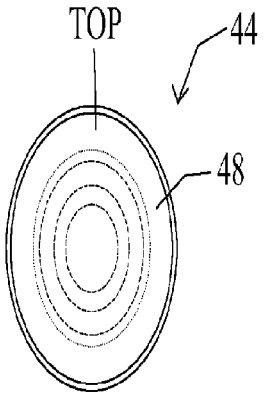
FIGS. 10A and 10B are top and perspective views, respectively, of the axial pin according to the present invention.
Figure 9B:
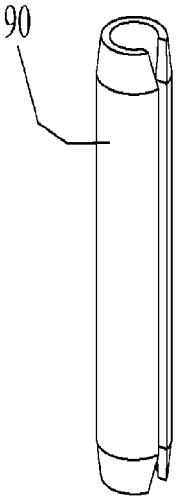
PRIOR ART FIG. 9B
Figure 10B:
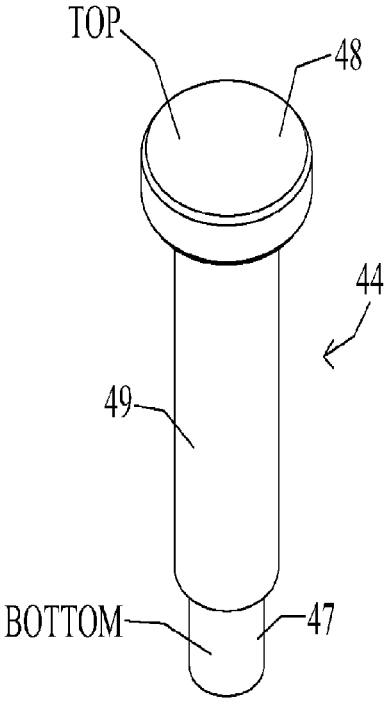

FIGS. 9A and 9B show top and side perspective views, respectively, of a prior art roll pin 90. By comparison, FIGS. 10A and 10B show top and side perspective views, respectively, of the axial pin 44 used with the preferred embodiment charging handle assembly 10. The axial pin 144 used with the alternate embodiment charging handle 100 assembly is identical to axial pin 44.

Illustrated in FIG. 11 is a left side perspective view of an M16 type rifle 80 having an upper receiver 70, lower receiver 71, buttstock 72 and barrel 73 that is equipped with the charging handle assembly 10 disclosed herein. In particular it is shown how the hook 43 portion of the primary handle 41 engages with an indentation 74 on the upper receiver 70.

The foregoing description and drawings should be considered illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A charging handle assembly for a rifle having a receiver, comprising:

a body portion comprising a shaft integrally connected to a transverse member constructed as a grasping handle at a rearward end;

said grasping handle comprising a rotatable handle with an integral hook;

said grasping handle comprising a recess;

said rotatable handle comprising a body portion with said integral hook located at a distil end of said rotatable handle connected to a grasping surface, wherein said rotatable handle is within said recess located of said grasping handle;

said rotatable handle comprising a protrusion located at a proximal end of said rotatable handle;

said body portion comprising a bolt carrier engagement portion at a forward end of said shaft;

said rotatable handle is housed within a recess formed between a top surface and a bottom surface of a left side of said grasping handle;

a longitudinal opening located on a backside of said grasping handle, with said longitudinal opening sized to receive a spring and a plunger and extending longitudinally along a portion of a main axis of said body portion perpendicular to an interior aperture;

a spring and a plunger, said plunger comprising at least one recess, and said spring and plunger being housed within said longitudinal opening;

an axial pin attaching said rotatable handle to said grasping handle through an opening on a top side of said grasping handle.

2. The charging handle assembly of claim 1, wherein said interior aperture is defined by an interior side wall that is shorter in length than a second side wall that forms an interior portion of a backside of said charging handle.

3. The charging handle assembly of claim 1, wherein said interior aperture is positioned and sized for said protrusion of said rotatable handle to be received within said recess of said plunger.

4. The charging handle assembly of claim 1, wherein said rotatable handle extends laterally beyond a left side exterior of said grasping handle.

5. The charging handle assembly of claim 4, wherein said lateral extension is approximately 0.189 inches.

6. The charging handle assembly of claim 1, wherein said shaft and grasping handle are made from aluminum or other alloys with similar structural characteristics.

7. The charging handle assembly of claim 6, wherein said shaft and grasping handle are machined from a single piece of aluminum or other alloy with similar structural characteristics.

8. The charging handle assembly of claim 1, wherein said grasping surface comprises a textured surface.

9. The charging handle assembly of claim 8, wherein said textured surface comprises a series of latitudinal furrows.

10. The charging handle assembly of claim 1, wherein said axial pin comprises a head portion, a body portion and tail portion.

11. The charging handle assembly of claim 10, wherein said tail portion of said axial pin is narrower than said body portion.

12. The charging handle assembly of claim 11, wherein said axial pin is a fastener with a bottom portion of said tail portion of said axial pin expanded by deformation.

* * * * *